US005379576A

United States Patent [19]

Koyama

[11] Patent Number: 5,379,576

[45] Date of Patent: Jan. 10, 1995

[54] BAND FEEDING AND TIGHTENING APPARATUS FOR PACKING MACHINE

[75] Inventor: Seiichiro Koyama, Tokyo, Japan

[73] Assignee: Strapack Corporation, Tokyo, Japan

[21] Appl. No.: 72,541

[22] Filed: Jun. 4, 1993

[30] Foreign Application Priority Data

Jun. 10, 1992 [JP] Japan ..... 150887

[51] Int. Cl.[6] ..... B65B 13/04; B65B 41/10

[52] U.S. Cl. ..... 53/589; 53/389.4; 100/26; 100/32

[58] Field of Search ..... 100/25, 29, 32, 26; 53/589, 389.4

[56] References Cited

U.S. PATENT DOCUMENTS

| | | | |
|---|---|---|---|
| 2,279,843 | 4/1942 | Smith et al. | 53/389.4 X |
| 2,648,382 | 8/1953 | Dewyer | 53/389.4 X |
| 3,899,864 | 8/1975 | Uchida et al. | 53/389.4 X |
| 4,155,799 | 5/1979 | Matsushita et al. | 53/589 X |
| 4,559,767 | 12/1985 | Takami | 53/589 |
| 4,575,994 | 3/1986 | Takami | 53/589 X |
| 4,605,456 | 8/1986 | Annis | 53/589 |
| 4,955,180 | 9/1990 | Sakaki et al. | 53/589 X |

*Primary Examiner*—Linda B. Johnson
*Attorney, Agent, or Firm*—Steinberg, Raskin & Davidson

[57] ABSTRACT

A band feeding and tightening apparatus for a packing machine capable of effectively preventing jamming of a band in band passages during feeding and tightening of the band. A feed touch roller is pressedly contacted through the band with a feed roller rotated at a high speed, to thereby feed the band to a package. When a distal end of the band is gripped, a return touch roller is pressedly contacted through the band with a return roller rotated at a high speed, to thereby draw back the band, resulting in the band being wound around the package. Then, a tension touch roller is pressedly contacted through the band with a tension roller, to thereby tighten the band. Subsequently, an overlapped portion of the band is bonded by welding and a portion of the band wound around the package is cut from the remaining part of the band. A movable guide plate is moved in association with pressing of the feed touch roller to reduce a gap of a feed chute. Also, a tension chute of an arc-like shape is moved in a chord direction of the arc in association with pressing of the tension touch roller, so that a gap of a portion of the tension chute communicating with the return chute is enlarged and that communicating with the feed chute is reduced. Thus, the gap of each of the chutes is varied when feeding and tightening of the band are carried out, to thereby ensure that the band is always delivered from the chute of which the gap is reduced to the chute of which the gap is enlarged to substantially prevent jamming of the band in the band passages.

8 Claims, 10 Drawing Sheets

A12
44
4
12b
M
67b
43
12a
11
13
86
90
96
95
52
22
67a
10
14
91
68
26
25
21
24
28
99
94
98
97
27
23
12c
20
87
88
55

BAND FEEDING AND TIGHTENING APPARATUS FOR PACKING MACHINE

BACKGROUND OF THE INVENTION

This invention relates to a packing machine for feeding a band around a package such as a box or the like, drawing back the band to tighten it around the package while grasping a distal end of the band, bonding an overlapped portion of the band by welding or the like and cutting a portion of the band wound on the package from the remaining portion of the band, and more particularly to a band feeding and tightening apparatus provided on a packing machine and including plural pairs of rollers for carrying out feeding, drawing-back and tightening of a band.

A conventional packing machine is generally constructed so as to unwind a band from a reel on which the band is wound, feed the band to a pool box by means a pool feed roller and a pool touch roller arranged in a pair to temporarily pool it in the pool box, and then feed the band through a band feeding and tightening apparatus to a circumference of a package such as a box. Such feeding of the band to the circumference of the package is generally carried out employing, for example, an arch structure provided on a table on which the package is to be put. The arch structure and table each are formed therein with a band passage, so that the band may be circularly fed to the circumference of the package. Then, the band is clamped or grasped at a distal end thereof, followed by being drawn back by the rollers arranged in the band feeding and tightening apparatus. The arch structure and table each have a circular inner surface, which is formed with a slit; so that when application of band drawing-back force to the band fed into the arch structure and table causes the band to rush out of the slits, resulting in being wound around the package. The band is then tightened. Subsequently, the band is bonded at an overlapped portion thereof by welding or the like while being kept tightened. Thereafter, a portion of the band wound on the package is cut from the remaining portion of the band.

Now, such a conventional band feeding and tightening apparatus will be more specifically described with reference to FIG. 10. Feeding of a band is carried out by accessing feed touch rollers 35*a* and 35*b* through the band to a feed roller 31 rotated at a high speed. Drawing-back and tightening of the band is carried out by accessing a return touch roller 36 through the band to the return roller 33.

More particularly, the feed touch rollers 35*a* and 35*b* are pressedly contacted with the feed roller 31 while keeping a feed shaft 32 on which the feed roller 31 for feeding the band is fixedly mounted and a return shaft 34 on which the return roller 33 is fixedly mounted rotated through a differential speed reducer in directions opposite to each other, resulting in the band being fed. Drawing-back of the band is carried out by pressedly contacting the return touch roller 36 with the return roller 33. When the drawing-back is advanced to cause force applied to the return roller 33 by the band to reach a predetermined level, a clutch provided on the return shaft 34 starts to slip, resulting in rotation of the return shaft 34 being rapidly decreased. This causes the differential speed reducer to rotate the return roller 33 at a low speed and a high torque, so that tightening of the band may be accomplished.

The conventional band feeding and tightening apparatus thus constructed is disclosed in Japanese Patent Publication No 34051/1980 (55-34051), of which the disclosure is incorporated therein by reference.

In the conventional band feeding and tightening apparatus described above, the band is taken out of a pool box, passed through a guide chute 42 in which a band passage 41*d* is defined, and then fed to a space between the feed touch roller 35*b* and the feed roller 31 being rotated at a high speed. Then, the band is passed through a feed chute 38 in which a band passage 41*c* is defined and then passed between the return roller 33 and the return touch roller 36 which are kept separated from each other. Also, the band is passed through a band passage 41*b* defined between an outer periphery of the return roller 33 and an inside of a tension chute 37 and then fed to a space between the feed touch roller 35*a* and the feed roller 31 being rotated at a high speed. Thereafter, the band is passed through a return chute 39 in which a band passage 41*a* is defined and then fed to an arch structure (not shown).

Then, the band is grasped at a distal end thereof by a grasping unit (not shown). Then, the feed touch rollers 35*a* and 35*b* are separated from the feed roller 31 and the return roller 36 is pressedly contacted through the band with the return roller 33. This causes the band to be drawn back, resulting in rushing out of a slit of the arch structure and a slit of a table (not shown). Then, the return roller 33 tightens the band.

Unfortunately, the conventional band feeding and tightening apparatus constructed as described above often leads to jamming of the band in the band passages. More specifically, the band is caught in the band passages, resulting in being folded in a corrugated or crumpled manner in the band passages. The jamming is caused due to the reason that a distal end of the band is caught in the band passage when the band is unwound from a reel and fed to the band feeding and tightening apparatus at the time of starting the packing machine or due to the reason that the band is caught at an intermediate portion thereof in the band passage due to friction between the intermediate portion of the band and the band passage when the band is fed or drawn back at a high speed during running of the packing machine.

The jamming tends to readily occur when the band used lack firmness or nerve. Catching of the band in the band passage tends to occur at a boundary area between the band passages such as a boundary area between the guide chute and the tension chute, that between the tension chute and the return chute, or the like. Also, the catching readily occurs at a gap between the feed touch roller 35*a* or 35*b* and the guide chute 42 or return chute 39 when the feed touch rollers 35*a* and 35*b* are kept separated from the feed roller 31.

In addition, the conventional band feeding and tightening apparatus is so constructed that the band passage 41*b* of the tension chute 37 is formed into an increased width so as to prevent the band from contacting with the return roller 33 constantly rotated at a high speed in a direction opposite to the feed roller 31 when the band is being fed by the feed roller 31. Unfortunately, such construction exhibits a disadvantage that when the band is caused to unintendedly contact with the return roller 33, it is exposed to force applied thereto in a direction opposite to a direction of feeding of the band, resulting in jamming of the band in the band passage 41*b* increased in width.

SUMMARY OF THE INVENTION

The present invention has been made in view of the foregoing disadvantage of the prior art.

Accordingly, it is an object of the present invention to provide a band feeding and tightening apparatus for a packing machine which is capable of substantially preventing the apparatus from being jammed with a band.

It is another object of the present invention to provide a band feeding and tightening apparatus for a packing machine which is capable of effectively preventing jamming of a band at a boundary area between band passages communicating with each other.

It is a further object of the present invention to provide a band feeding and tightening apparatus for a packing machine which is capable of varying a dimension of a band passage as desired, to thereby prevent jamming of a band in the band passage.

In accordance with the present invention, a band feeding and tightening apparatus for a packing machine is provided which is adapted to feed a band to a package to surround it with the band, grip a distal end of the band, draw back the band to tighten it, bond an overlapped portion of the band and cut a portion of the band wound around the package from the remaining portion of the band. The band feeding and tightening apparatus includes a feed roller rotated at a high speed to feed the band, a feed touch roller arranged so as to access through the band to the feed roller, a return roller rotated at a high speed to draw back the band, a return touch roller arranged so as to access through the band to the return roller, a tension roller rotated at a low speed and a high torque to tighten the band, a tension touch roller arranged so as to access through the band to the tension roller, a feed chute arranged so as to provide a band passage between the feed roller and the tension roller, a tension chute arranged so as to communicate with the feed chute and formed into an arc-like shape, resulting in providing a band passage around the tension roller, a return chute arranged so as to communicate with the tension chute and provide a band passage between the tension roller and the return roller, and a dimension varying mechanism for reducing a gap of the feed chute defined in a direction of thickness of the band to a dimension approaching, as close as possible, a lower limit dimension which permits passing of the band when the band is fed and enlarging the gap when the band is drawn back or tightened.

Such construction of the present invention permits the band to be moved from the enlarged band passage to the reduced band passage between the feed chute and the tension chute during drawing-back of the band as well as during the feeding, to thereby effectively prevent jamming of the band in the passages.

In a preferred embodiment of the present invention, the feed chute comprises a stationary guide plate and a movable guide plate with a space being defined therebetween and the dimension varying mechanism comprises an association mechanism for moving the movable guide plate in association with access movement of the feed touch roller.

Also, in accordance with the present invention, a band feeding and tightening apparatus for a packing machine is provided which is adapted to feed a band to a package to surround it with the band, grip a distal end of the band, draw back the band to tighten it, bond an overlapped portion of the band and cut a portion of the band wound around the package from the remaining portion of the band. The band feeding and tightening apparatus includes a feed roller rotated at a high speed to feed the band, a feed touch roller arranged so as to access through the band to the feed roller, a return roller rotated at a high speed to draw back the band, a return touch roller arranged so as to access through the band to the return roller, a tension roller rotated at a low speed and a high torque to tighten the band, a tension touch roller arranged so as to access through the band to the tension roller, a feed chute arranged so as to provide a band passage between the feed roller and the tension roller, a tension chute arranged so as to communicate with the feed chute and formed into an arc-like shape, resulting in providing a band passage around the tension roller, a return chute arranged so as to communicate with the tension chute and provide a band passage between the tension roller and the return roller, and a dimension varying mechanism for varying a dimension of a gap of the arc-like tension chute defined in a direction of thickness of the band. The dimension varying mechanism varies the dimension in such a manner that when the band is fed, the gap of a portion of the arc-like tension chute communicating with the return chute is reduced to a dimension approaching, as close as possible, a lower limit dimension which permits passing of the band and the gap of a portion of the arc-like tension chute communicating with the feed chute is enlarged and in such a manner that when the band is tightened, the gap of a portion of the arc-like tension chute communicating with the return chute is enlarged and the gap of a portion of the arc-like tension chute communicating with the feed chute is reduced to a dimension approaching, as close as possible, a lower limit dimension which permits passing of the band.

Such construction of the present invention permits the band to be moved from the enlarged band passage to the reduced band passage between the tension chute and the return chute and between the tension chute and the feed chute during drawing-back of the band as well as during the feeding, to thereby effectively prevent jamming of the band in the passages.

In a preferred embodiment of the present invention, the tension chute comprises a member provided around the tension roller and formed with a recess of an arc-like shape which is concentric with the tension roller and the dimension varying mechanism comprises an association mechanism for moving the tension chute in a chord direction of the arc in association with access movement of the tension touch roller.

In a preferred embodiment of the present invention, the association mechanism is so constructed that a shaft of the feed touch roller which carries out the access movement is inserted into an insertion hole formed through the movable guide plate and a guide pin mounted on a base of the apparatus so as to project therefrom is inserted into an elongated hole formed through the movable guide plate, resulting in a direction of movement of the movable guide plate being regulated by the elongated hole.

In a preferred embodiment of the present invention, the association mechanism is so constructed that an arm rod which permits the tension touch roller to carry out the access movement is engaged with the tension chute and a guide pin mounted on a base of the apparatus so as to project therefrom is inserted into an elongated hole formed through the tension chute, resulting in a direction of movement of the tension chute being regulated by the elongated hole.

Thus, the chute is moved in association with the access movement of the touch roller to vary the gap of the chute, to thereby substantially eliminate formation of a space between the touch roller and the chute, jamming of the band in the space may be effectively prevented.

Further, in the present invention, the return roller rotated at a high speed to draw back the belt and the tension roller rotated at a low speed and a high torque to tighten the band are provided separate from each other, so that it is not required to reversely rotate the tension roller around which the band is passed at a high rotational speed, resulting in substantially preventing jamming of the band due to contact of the band with the tension roller.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a band feeding and tightening apparatus according to the present invention will be described hereinafter with reference to FIGS. 1 to 9.

Figure 1:
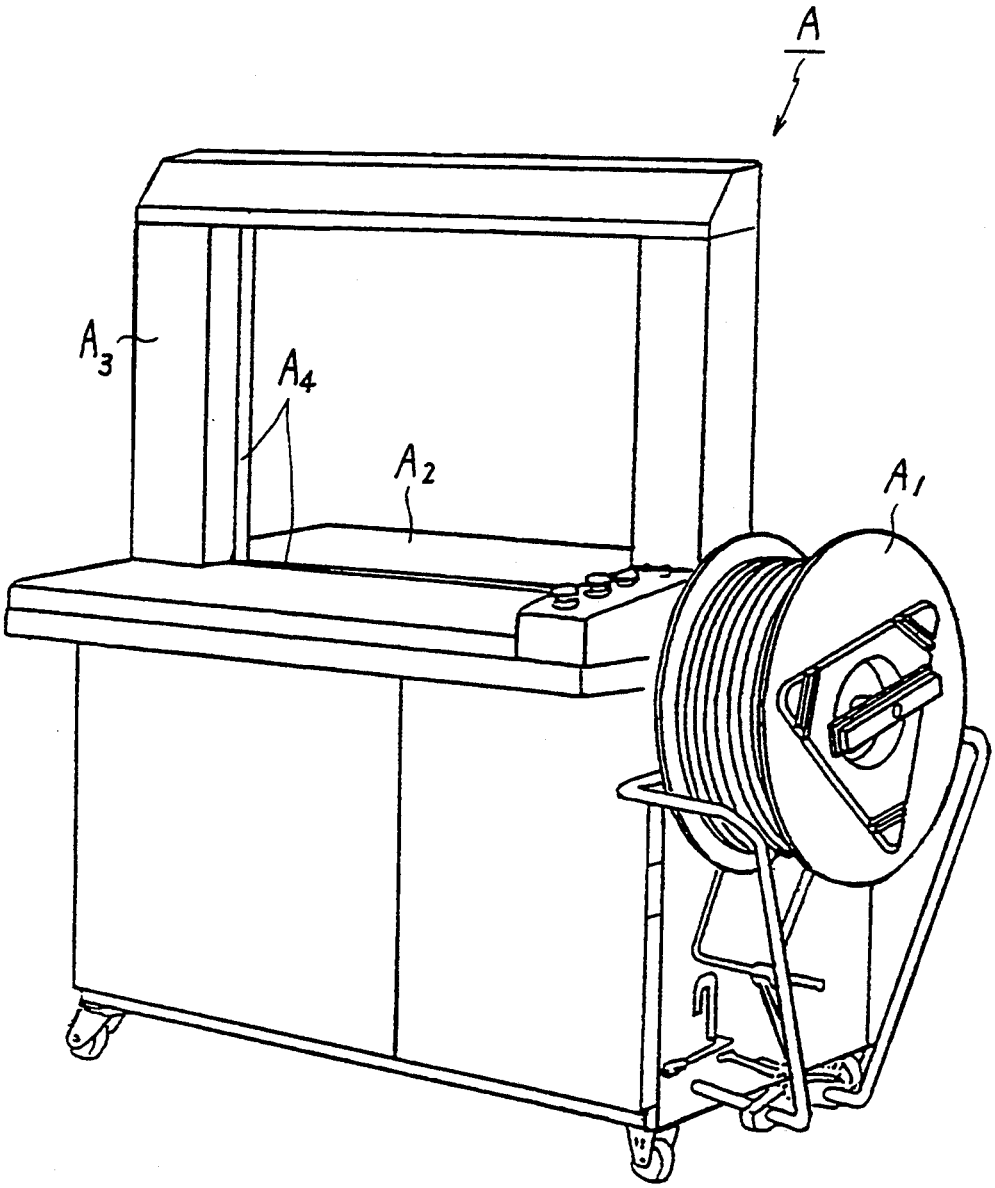
FIG. 1 is a schematic perspective view generally showing an appearance of a packing machine in which a band feeding and tightening apparatus according to the present invention is incorporated.

Referring first to FIG. 1, a packing machine in which an embodiment of a band feeding and tightening apparatus of the present invention is incorporated is illustrated. The packing machine generally designated at reference character A includes a reel A1 and a table A2, which is adapted to put a package such as a box or the like thereon. The table A2 is provided thereon with an arch structure A3, so that an upper surface of the table A2 and an inner periphery of the arch structure A3 cooperate with each other to form a rectangular ring-like inner peripheral surface, which is formed with a slit A4 extending over the whole surface; so that application of band drawing-back force to a band permits the band to rush out of the slit A4, resulting in the band being fed to the package to surround it.

Figure 2:
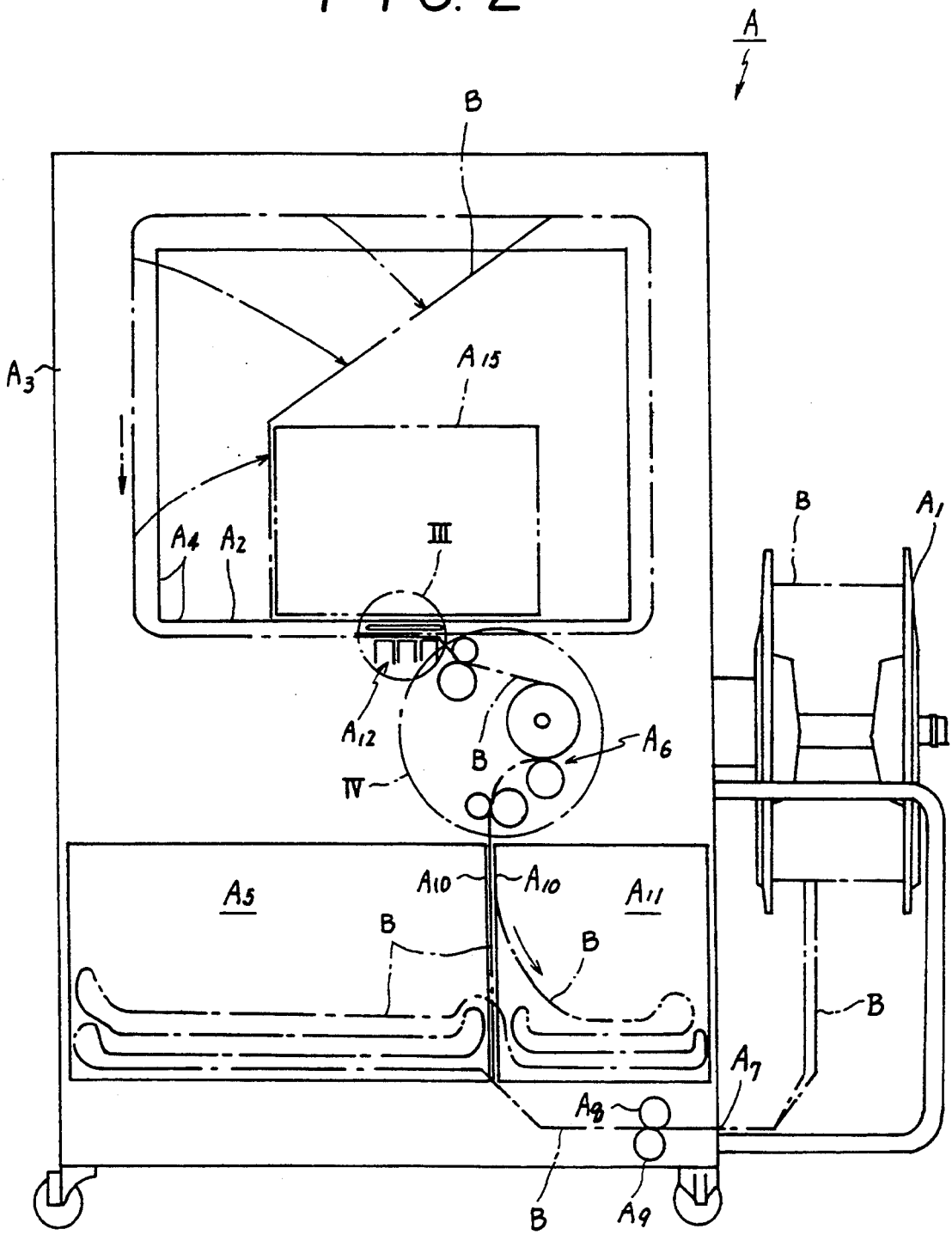
FIG. 2 is a schematic vertical sectional view of the packing machine shown in FIG. 1.

As shown in FIG. 2, the packing machine A is provided therein with a pool box A5 for temporarily storing a band B therein and a band feeding and tightening apparatus A6 according to an embodiment of the present invention.

Now, a function of the whole packing machine A will be described with reference to FIG. 2.

The band B unwound from the reel A1 is fed through a band inlet A7 of the packing machine A into the packing machine A and pressedly contacted with a pool feed roller A8 by a pool touch roller A9. This causes the band B to be upwardly directed along a band passage which is formed by two openable guide plates A10 pivotally provided in the pool box A5. After a distal end of the band B reaches the band feeding and tightening apparatus A6 of the illustrated embodiment, the guide plates A10 each are pivotally moved about an axis defined in parallel to the sheet of FIG. 2, to thereby permit the band to be fed to a pool box A5 and a back pool box A11. The pool box A5 acts to temporarily store therein the band B fed by the pool feed roller A8 and the back pool box A11 serves to store therein the band B drawn back from the band feeding and tightening apparatus A6.

The band feeding and tightening apparatus A6 is adapted to feed the band B into the arch structure A3 at a high speed, draw back it after the distal end of the band B is grasped, and then tighten it. A portion of the table A2 on which the slit A4 is formed is provided on an underside thereof with a band gripping and bonding unit A12 which functions to grip the distal end of the band and bond an overlapped portion of the band by welding.

Figure 3:
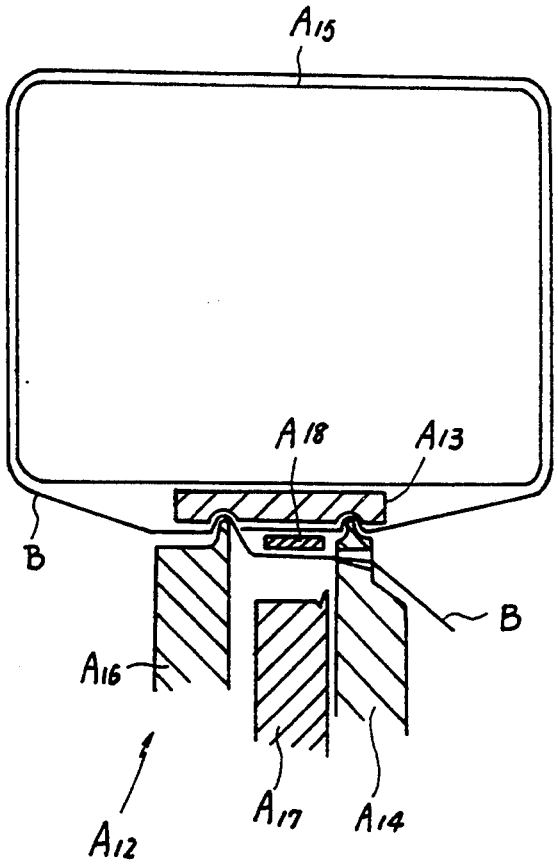
FIG. 3 is an enlarged view showing a section encircled by dashed lines III in FIG. 2.

The band gripping and bonding unit A12 may be constructed in such a manner as generally shown in FIG. 3. More particularly, the distal end of the band B which has been fed to the arch structure A3 so as to travel round the arch structure is pressed and grasped at the distal end thereof by a right-side block A14 upwardly moved with respect to a lower surface of a slide table A13. Then, the band B is drawn back to cause to rush out of the slit A4, resulting in being wound around the package. Subsequently, a left-side block A16 is upwardly moved to press the band B against the slide table A13 to keep the band B tightened. Thereafter, an intermediate block A17 is lifted to cut a part of the band B wound on the package A15 from the remaining part of the band. Then, an overlapped portion of the band B wound on the package A15 is melted on both sides thereof by means of a heater A18, which is then retracted in a direction perpendicular to the sheet of FIG. 3. Also, the intermediate block A17 is further upwardly moved to press the overlapped portion of the band B against the slide table A13, so that the overlapped portion is subject to welding. Then, the blocks A14, A16 and A17 are downwardly moved to cause the slide table A13 to be retracted in the direction perpendicular to the sheet of FIG. 3.

Now, the band feeding and tightening apparatus A6 of the illustrated embodiment will be described hereinafter with reference to FIGS. 4 to 9.

Figure 4:
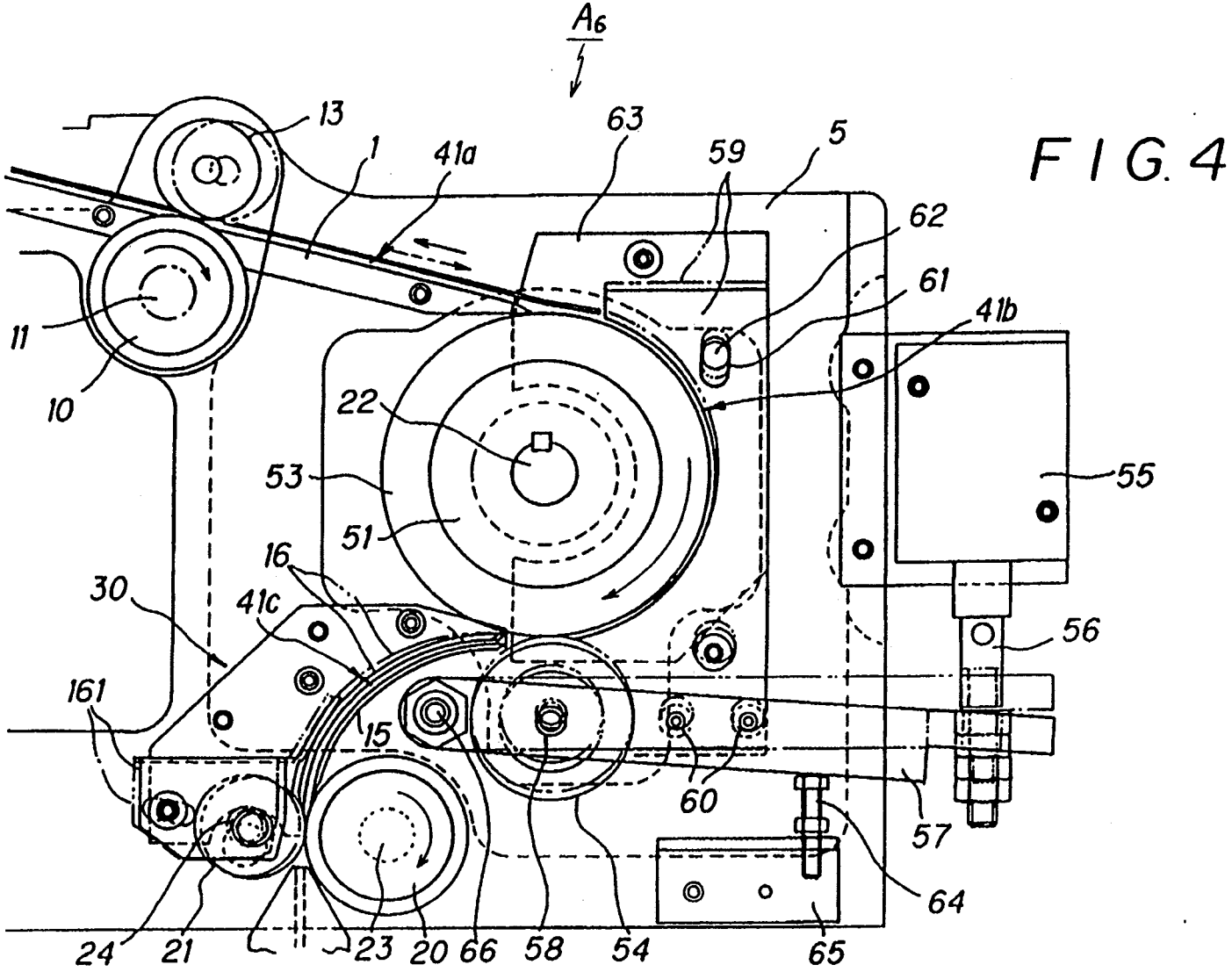
FIG. 4 is an enlarged view showing a section encircled by dashed lines IV in FIG. 2.

The band feeding and tightening apparatus A6 of the illustrated embodiment includes a feed roller 20 for feeding the band, which roller 20 is adapted to be rotated at a high speed in a direction indicated at an arrow in FIG. 4. The apparatus also includes a feed touch roller 21 arranged so as to be accessible to the feed roller 20 through the band. Further, the band feeding and tightening apparatus A6 includes a return roller 10 adapted to draw back the band and rotated at a high speed in a direction indicated at an arrow and a return touch roller 13 arranged so as to be accessible to the return roller 10 through the band. In addition, the band feeding and tightening apparatus A6 includes a tension roller 51 adapted to tighten the band and rotated at a low speed and a high torque in a direction indicated at an arrow and a tension touch roller 54 arranged so as to be accessible to the tension roller 51 through the band.

Between the feed roller 20 and the tension roller 51 is defined a band passage 41*c*, which, in the illustrated embodiment, is formed by a feed chute 30. Also, around the tension roller 51 is defined a band passage 41*b*, which is formed by a tension chute 59 of an arcuate shape. Between the tension roller 51 and the return roller 10 is defined a band passage 41*a*, which is formed by a return chute 1. The feed chute 30 is arranged so as to communicate with the tension chute 59, which is arranged so as to communicate with the return chute 1.

The feed chute 30 is constituted by a stationary guide plate 15 and a movable guide plate 16. Between the stationary guide plate 15 and the movable guide plate 16 is defined a gap. The movable guide plate 16 is arranged so as to be moved in association with accessible movement of the feed touch roller 21, to thereby vary a distance of the gap.

The tension chute 59 is provided around the tension roller 51 or in proximity to an outer periphery of the tension roller 51 and comprises a member arranged so as to be concentric with the tension roller 51 and formed with a recess of an arc-like shape in section. Between the tension chute 59 thus formed and the outer periphery of the tension roller 51 is formed a gap, which serves as the band passage 41*b* described above. The tension chute 59 is adapted to be moved in a substantially chord direction of the arc in association with accessible movement of the tension touch roller 54 to vary a distance of the gap.

Figure 5:
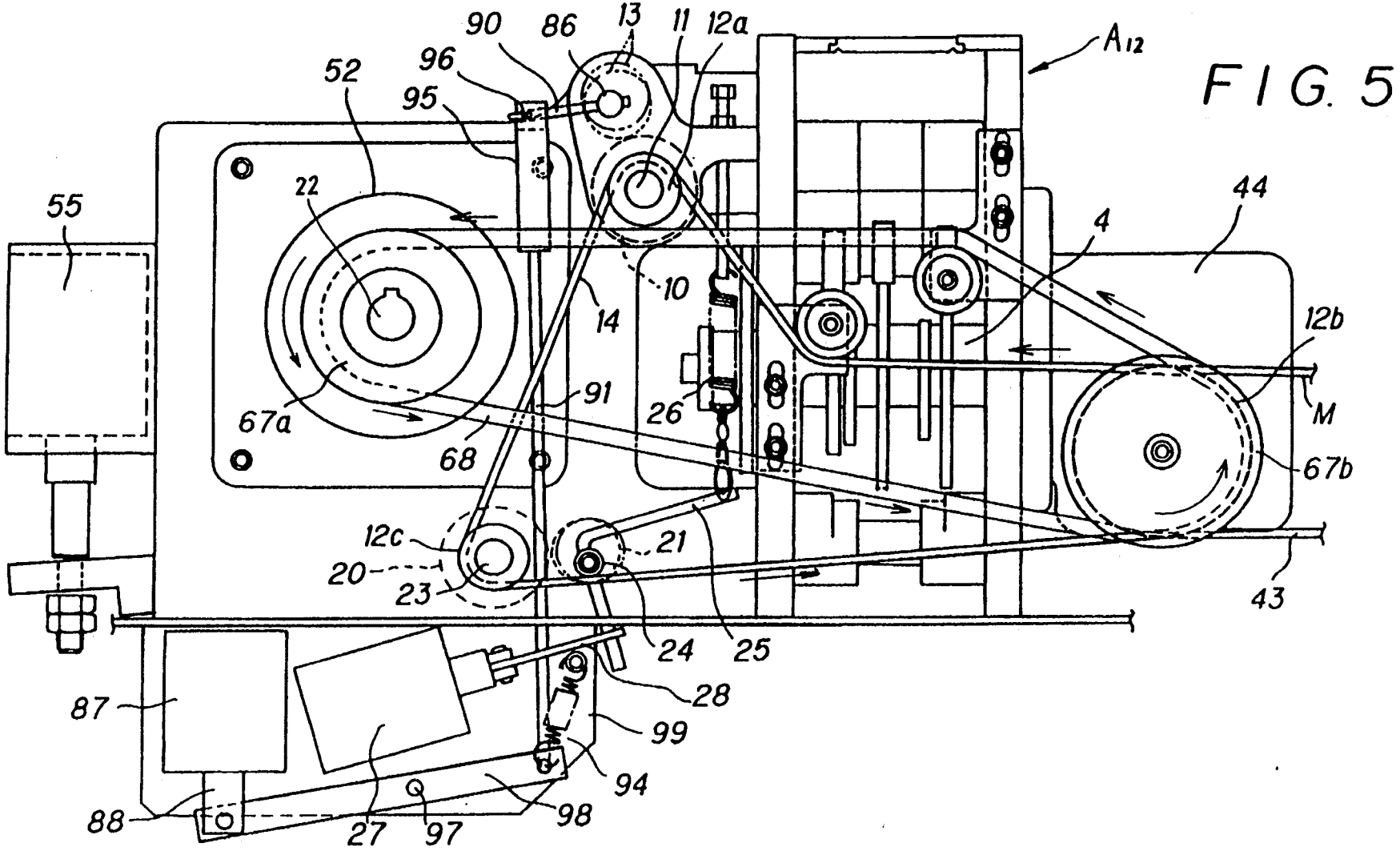
FIG. 5 is a rear view of the section shown in FIG. 4.
Figure 6:
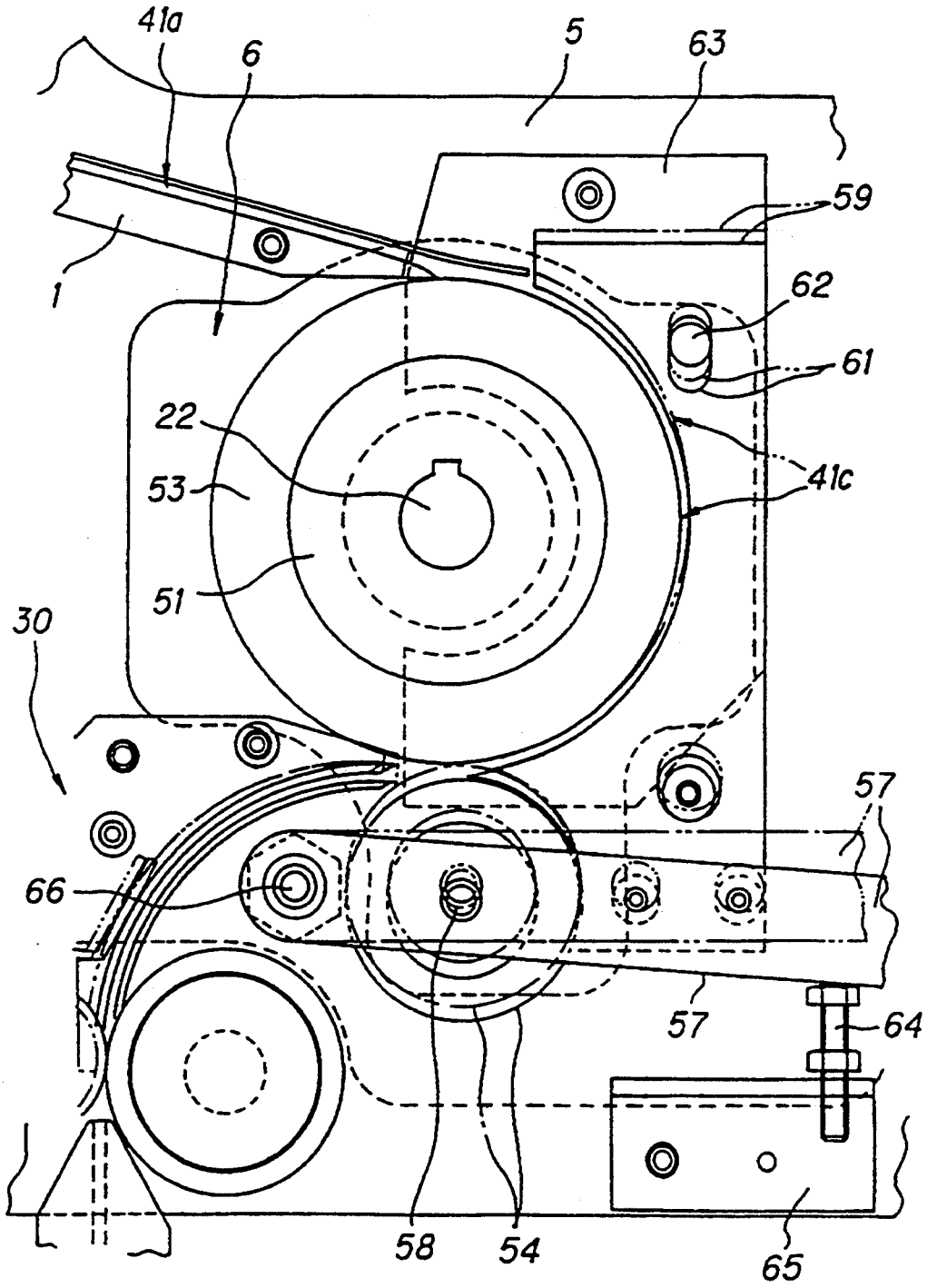
FIG. 6 is an enlarged view showing an essential part of the section shown in FIG. 4.

The return roller 10, as shown in FIG. 5, includes a drive shaft 11, of which an end is arranged so as to outwardly extend from a back surface of a base 5 of the apparatus A6 and mounted thereon with a pulley 12*a* for a flat belt 14, which is arranged so as to extend between the pulley 12*a* and a pulley 12*b* and around both pulleys. The pulley 12*b* is mounted on an input shaft of a cam shaft reducer 44 for driving a cam shaft 4 which actuates the above-described blocks of the band gripping and bonding unit A12. Also, the pulley 12*b* is adapted to be constantly rotated through a belt 43 by means of a motor (not shown), so that the return roller 10 is likewise constantly rotated. The cam shaft 4 is so constructed that rotation thereof is controlled by an electromagnetic clutch for the cam shaft which is provided on the input shaft.

The return touch roller 13 is mounted on an eccetric shaft 86 arranged separate from a revolving shaft and pivotally moved about the eccentric shaft 86 to carry out access movement with respect to the return roller 10. Pivotal movement of the return touch roller 13 is carried out through an actuation rod 90 of which one end is fixedly connected to the eccentric shaft 86. The actuation rod 90 is loosely fitted at the other end thereof in a groove 92 of a U-shape formed on a connecting element 95 and pivotally connected thereto by means of a split pin 96. To a lower end of the connecting element 95 is connected an association rod 91, which is pivotally connected at a lower end thereof to one end of an arm rod 98. The arm rod 98 is pivotally supported at an intermediate portion thereof on a supporting point 97 of a bracket 99 arranged below the base 5 and is connected at the other end thereof to a distal end of a rod 88 of a solenoid 87 provided on the bracket 99. Thus, the arm rod 98 is pivotally moved about the supporting point 97 of the bracket 99 depending on an action of the solenoid 87. The one end of the arm rod 98 is urged by a spring 94, resulting in urging the return touch roller 13 through the association rod 91 to press the return touch roller 13 against the return roller 10. Thus, the spring 94 and solenoid 87 permit the return touch roller 13 to carry out access movement. In the illustrated embodiment, the spring 94 is used for this purpose. Alternatively, the connecting element 95 may be provided therein with a compression spring. Also, a tension spring may be provided between the actuation rod 90 and the association rod 91.

The input shaft of the cam shaft reducer 44, as shown in FIG. 5, is also mounted thereon with a pulley 67*b*, which is arranged coaxial with the pulley 12*b* described above. The pulley 67*b* is mounted on the input shaft of the cam shaft reducer 44 through another tension roller electromagnetic clutch likewise arranged on the input shaft. The pulley 67*b* is connected to a pulley 67*a* through a V-belt 68. The pulley 67*a* is mounted on a rear end of a drive shaft 22 of a tension roller reducer 52 provided on the tension roller 51.

The tension roller 51 is formed into a large diameter and comprises a roller body made of a metal material and an elastic member 53 of increased frictional resistance arranged on an outer periphery of the roller body. The reducer 52 for the tension roller 51 is inserted into the base 5 of the apparatus A6 through a cutout 6 (FIG. 6) formed at the base and mounted on the back surface of the base 5.

The tension touch roller 54 which carries out access movement through the band with respect to the tension roller 51, as shown in FIG. 4, is rotatably mounted on a shaft 58 provided at an intermediate portion of an arm rod 57. The arm rod 57 is pivotally connected at one end thereof to a shaft 66 mounted on the base 5 and at the other end thereof to a distal end of a rod 56 of a solenoid 55. Thus, when the rod 56 of the solenoid 55 is retractably moved, the tension touch roller 54 carries out access movement with respect to the tension roller 51.

The tension chute 59 is provided on a side of an outer periphery of the tension roller 51 with which the band is contacted and comprises a member provided with a recess of arc-like shape and arranged concentric with the tension roller 51. Between the recess and the tension roller 51 is defined a gap, which forms the above-described band passage 41*b*. The band passage 41*b* of an arc-like shape is arranged so as to communicate at an upper end thereof with the return chute 1 and at a lower end thereof with the feed chute 30. The tension chute 59 is engaged at a lower portion thereof with the arm rod 57 through a pin 60. The tension chute 59 is formed at an upper portion thereof with an elongated hole 61 so as to extend in a vertical direction. Into the elongated hole 61 is inserted a guide pin 62 provided on a reinforcing plate 63 so as to project therefrom, which plate 63 is mounted on the base 5. Thus, when the rod 56 of the solenoid 55 stretchedly moved to pivotally move the arm rod 57, the tension chute 59 is vertically moved. The rod 56 is normally kept stretched and the arm rod 57 is downwardly pivotally moved as indicated at a solid line in FIG. 4, to thereby be abutted against a stopper 64 provided on a bracket 65. Also, the tension touch roller 54 is kept separated from the tension roller 51 and the tension chute 59 is located at a lower position.

Location of the tension chute 59 at such a lower position permits a gap or dimension of the band passage **41*b* defined in a direction of a thickness of the band to be reduced at an upper end or outlet of the band passage 41*b* formed by the tension chute 59 and increased at a lower end or inlet of the band passage 41*b*. More particularly, such location of the tension chute 59 causes the gap of the upper end or outlet of the band passage 41*b* communicating with the band passage 41*a* formed by the return chute 1 to be reduced to a dimension approximating, as close as possible, a lower limit dimension which permits passing of the band. Also, the gap of the lower end or inlet of the band passage 41*b* communicating with the band passage 41*c* formed by the feed chute 30 is enlarged to a dimension which is sufficient to permit free passing of the band. Such construction permits the band to be introduced into the band passage 41*b* through the lower end or inlet of the band passage of which the gap is enlarged and discharged from the band passage 41*b* through the upper end or outlet of the band passage 41*b* of which the gap is reduced during feeding of the band, so that jamming of the band in the band passage 41*b*** may be effectively prevented at both the inlet (lower end) and outlet (upper end) of the band passage.

When the solenoid 55 is excited to cause the rod 56 to be contracted, to thereby upwardly pivotally move the arm rod 57, the tension roller 54 is pressedly contacted through the band with the tension roller 51, resulting in the band being tightened. Concurrently, the arm rod 57 causes the tension chute 59 to be upwardly moved along the elongated hole 61. Location of the tension chute 59 at such an upper position when the band is tightened permits the dimension of the band passage **41*b* to be increased at the upper end of the band passage 41*b* and decreased at the lower end of the band passage 41*b*, in contrast with the above-described situation that the tension chute 59 is located at the lower position. More particularly, the dimension of the band passage 41*b* in the direction of thickness of the band is increased at the upper end of the band passage 41*b* communicating with the band passage 41*a* of the return chute 1 and decreased at the lower end of the band passage 41*b* communicating with the band passage 41*c* of the feed chute 30 to a degree approximating the lower limit dimension which permits passing of the band as close as possible. Such construction positively prevents jamming of the band at both the inlet and outlet of the band passage 41*b*** even when the band is moved in a direction opposite to the direction of feeding of the band for the purpose of being tightened.

The pool box A5 in which the band is temporarily stored is provided with a band outlet, at which the above-described feed roller 20 and feed touch roller 21 are arranged. The feed roller 20, as shown in FIG. 4, is mounted on the base 5 through a drive shaft 23. The drive shaft 23 is arranged so as to outwardly project from the back surface of the base 5 and, as shown in FIG. 5, provided thereon with a pulley **12*c*. On the pulley 12*c* is wound the above-described flat belt 14, resulting in being operatively connected to the pulley 12*a* of the return roller 10. The pulleys 12*a* and 12*c*** are rotated in the same direction or a direction in which the band is fed.

The feed touch roller 21 is rotatably mounted on an eccentric shaft 24 provided separate from a revolving shaft, to thereby carry out access movement with respect to the feed roller 20. The eccentric shaft 24, as shown in FIG. 5, is fixedly mounted on a rear end thereof with an L-shaped actuation rod 25. More particularly, the actuation rod 25 is fixed at a portion thereof in proximity to a bent portion thereof formed at a central region thereof on the eccentric shaft 24. The actuation rod 25 is urged at one end thereof by a spring 26, so that the feed touch roller 21 may be pressedly contacted with the feed roller 20. The actuation rod 25 is connected at the other end thereof to a distal end of a rod 28 of a solenoid 27; so that when the solenoid 27 is excited, the feed touch roller 21 is released or separated from the feed roller 20 against the spring 26.

The feed chute 30, as described above, defines the band passage 41c between the feed roller 20 and the tension roller 51. The .feed chute 30, as described above and shown in FIGS. 7 to 9, comprises the stationary guide plate 15 and movable guide plate 16. The stationary guide plate 15 is integrally provided on a surface of a mounting plate 151 provided on the base 5 and formed into an L-shape in section. The movable guide plate 16 is arranged so as to face the stationary guide plate 15 with a gap being interposed therebetween. Both guide plates 15 and 16 each are formed into a curved shape, therefore, the band passage **41*c*** is likewise formed into a curved shape.

Figure 9:
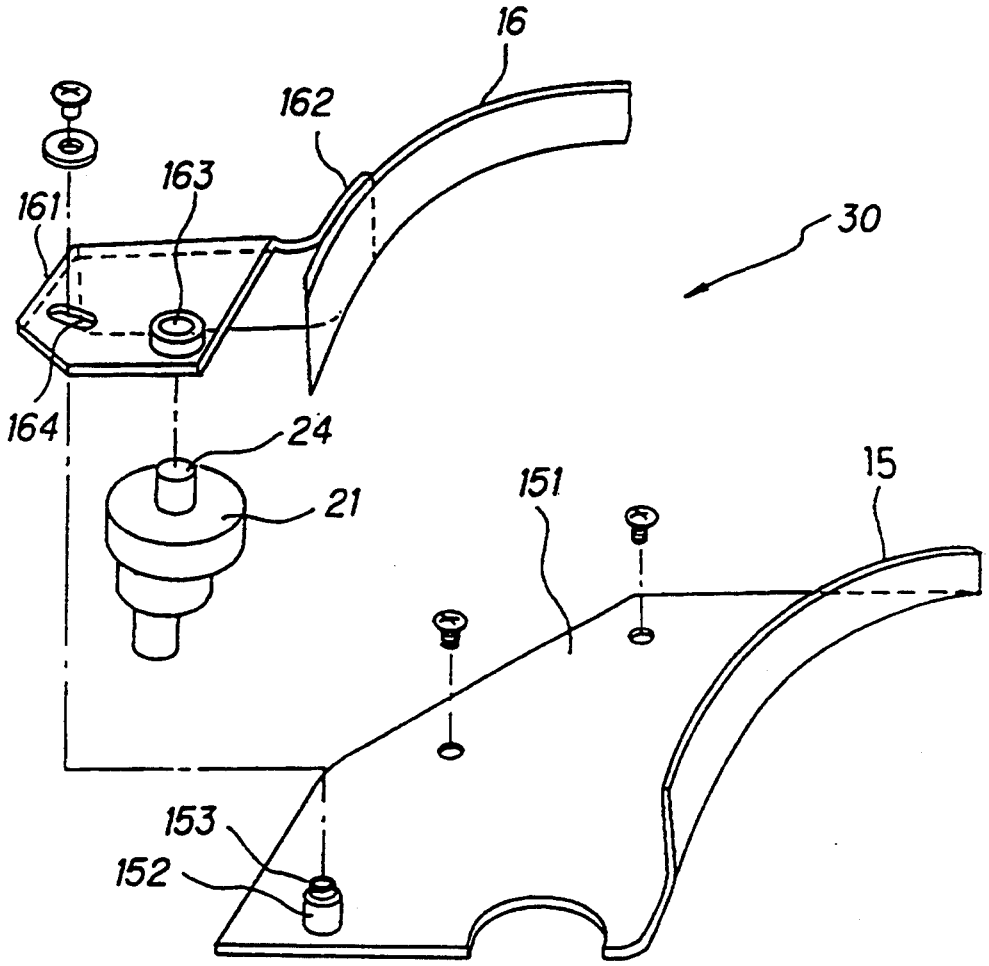
FIG. 9 is an exploded perspective view showing an essential part of FIG. 7.
Figure 10:
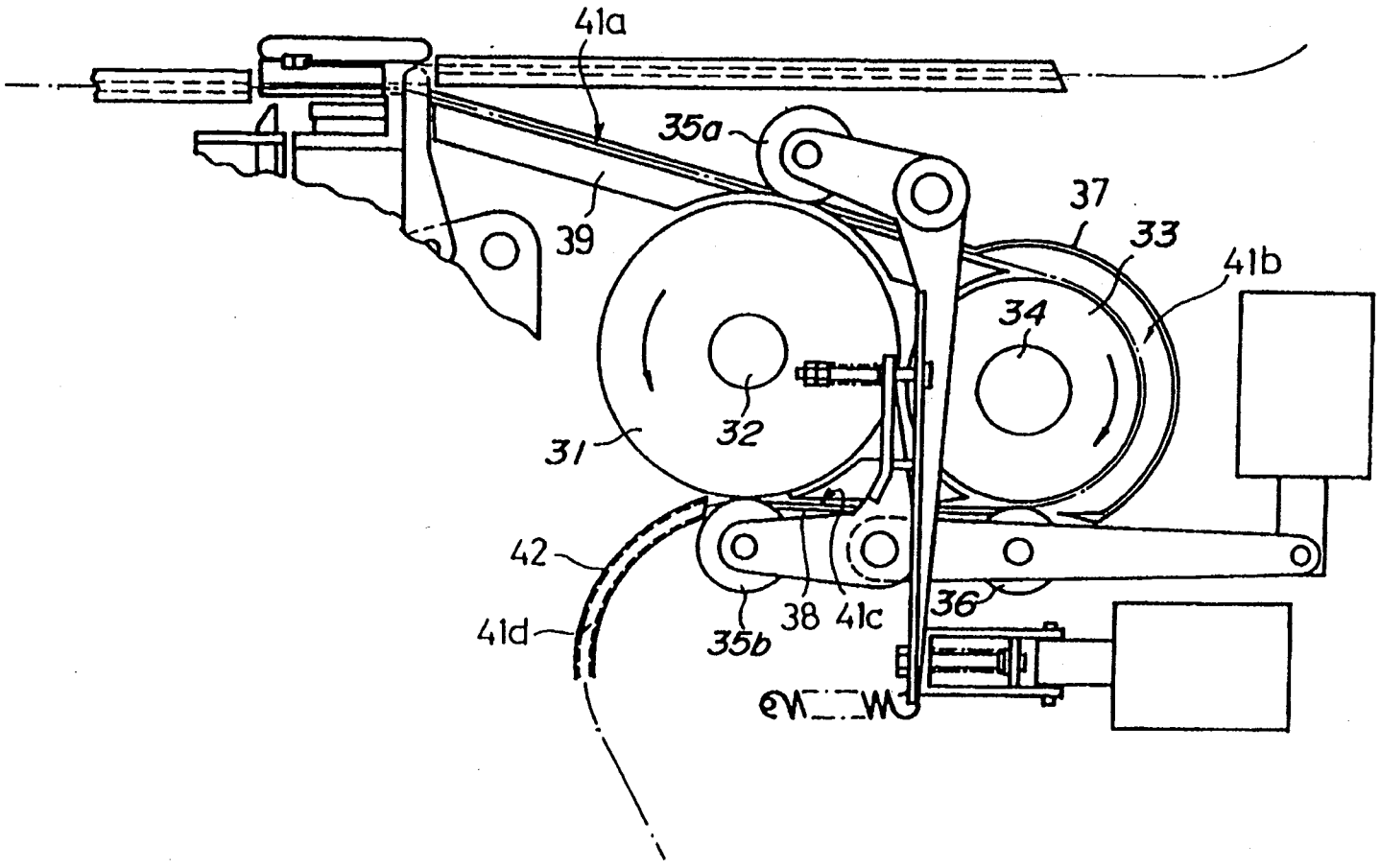
FIG. 10 PRIOR ART
FIG. 10 is a schematic view showing a conventional band feeding and tightening apparatus and corresponds to FIG. 4.

The movable guide plate 16, as shown in FIG. 9, is joined, by spot welding, to a bent member 162 mounted on a distal end of a guide plate support fitment 161 so as to project therefrom. The guide plate support fitment 161 is formed into an L-shape in section. Also, the guide plate support fitment 161 is formed with an insertion hole 163 and an elongated hole 164 in a manner to pass therethrough. Into the insertion hole 163 is inserted the eccentric shaft 24 of the feed touch roller 21. Into the elongated hole 164 is inserted a stepped portion 153 formed at a distal end of a guide pin 152 provided on the mounting plate 151 of the stationary guide plate 15 so as to project therefrom. The elongated hole 164 is so formed that a longitudinal axis thereof is directed toward the feed touch roller 21. Such arrangement of the elongated hole 164 permits the movable guide plate 16 to be moved along the elongated hole 164; so that a gap of the band passage **41*c* is increased, particularly, at a lower end of the band passage 41*c*** which communicates with the above-described band outlet of the pool box A5.

Now, the manner of operation of the band feeding and tightening apparatus A6 of the illustrated embodiment constructed as described above will be described hereinafter.

First, the band B fed from the pool box A5 (FIG. 2) is fed into a gap between the feed roller 20 and the feed touch roller 21 which are kept separate from each other. Such separation of the feed touch roller 21 from the feed roller 20 permits the gap of the band passage **41*c* formed by the feed chute 30 to be sufficiently enlarged. This facilitates feeding of the band B to the band passage 41*c* and prevents jamming of the band at the inlet of the band passage 41*c*. Then, the solenoid 27 is deenergized, so that the spring 26 causes the feed touch roller 21 to be pressedly contacted with the feed roller 20 through the band B. Such contacting of the feed touch roller 21 with the feed roller 20 leads to rotation of the feed roller 20 at an increased speed, to thereby feed the band B into the feed chute 30 at a high speed. At this time, pivotal movement of the eccentric shaft 24 of the feed touch roller 21 permits the guide plate 16 to be moved while being guided by the elongated hole 164 and guide pin 152. Such movement of the guide plate 16 permits the gap of the band passage 41c** to have a dimension approaching a lower limit dimension which permits passing of the band as close as possible.

Thus, when the band is once fed into the band passage 41c, the gap of the band passage 41c in the direction of thickness of the band is reduced or narrowed to prevent jamming of the band B in the band passage 41c.

Figure 7:
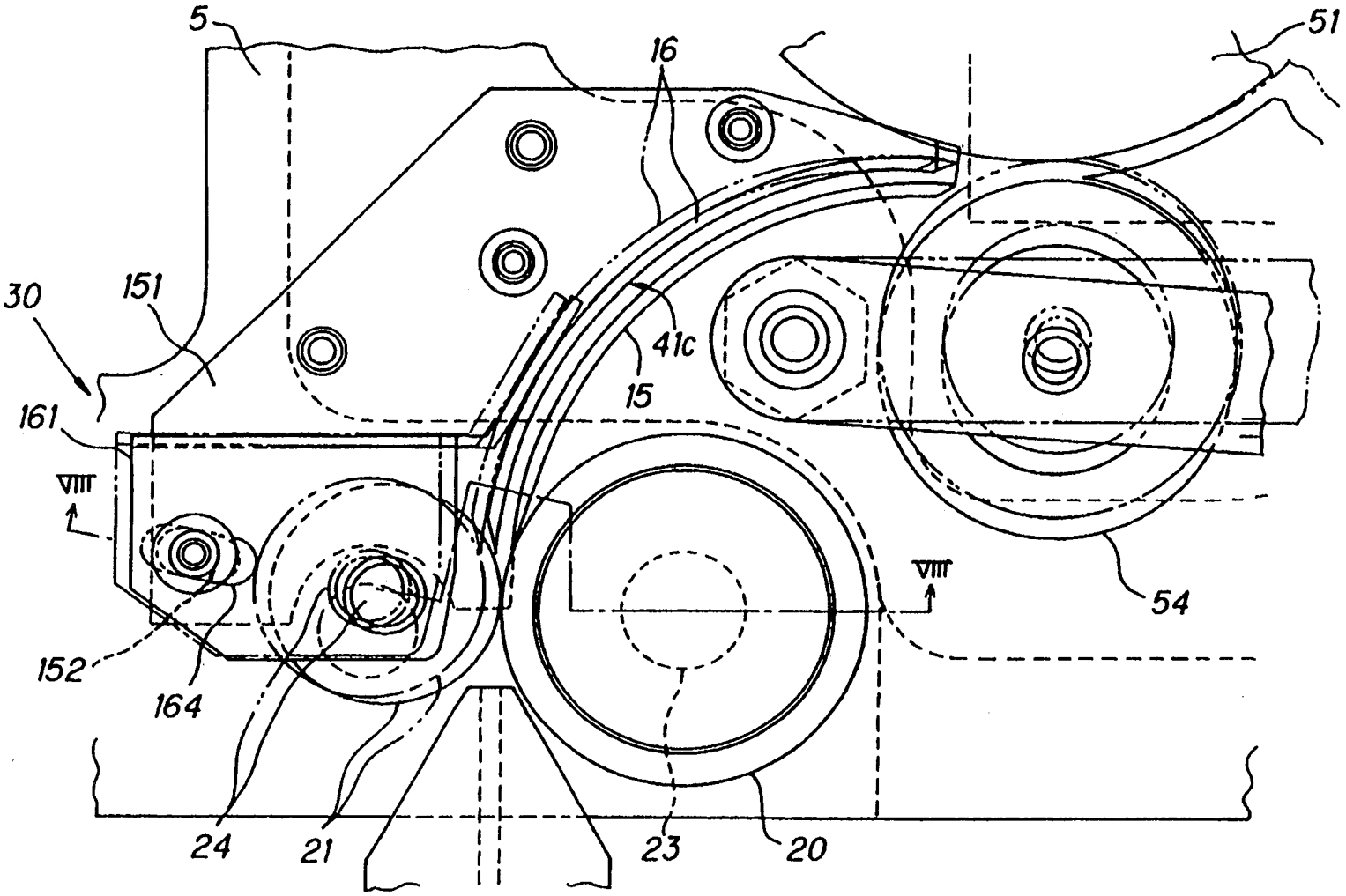
FIG. 7 is an enlarged view showing another essential part of the section shown in FIG. 4.

In FIGS. 4 and 7, the solenoid 55 is kept non-energized, so that the arm rod 57 is kept abutted against the stopper 64. The tension touch roller 54 is kept separated from the tension roller 51. Thus, a space between the tension roller 51 and the tension touch roller 54 is kept large, to thereby facilitate feeding of the band to the space between the tension roller 51 and the tension touch roller 54. Also, the tension chute 59 is located at the lower position, so that the gap of the lower end or inlet of the band passage 41b through which the band is fed into the band passage 41b is enlarged to facilitate feeding of the band to the band passage 41b. Also, the tension touch roller 54 is downwardly moved substantially simultaneous with the tension chute 59, to thereby prevent the band fed from entering the space between the tension touch roller 54 and the tension chute 59 kept separated from each other to cause jamming.

Also, the gap of the upper end or outlet of the band passage 41b through which the band is discharged from the band passage 41b is reduced to a dimension approaching, as close as possible, a lower limit dimension which permits passing of the band; so that the band may be smoothly moved through the thus-narrowed outlet to the next band passage 41a. Therefore, the illustrated embodiment prevents jamming of the band at a boundary area between the band passage 41b and the band passage 41a.

Thus, the illustrated embodiment permits the band to be smoothly and positively moved through the band passages 41c, 41b and 41a respectively formed by the chutes 30, 39 and 1, to thereby effectively prevent jamming of the band in the band passages, even when the band lacks nerve or rigidity.

The band thus fed to the band passage 41a is moved through a gap between the return roller 10 and the return touch roller 13 to the arch structure A3 (FIG. 2). Alternatively, when the packing machine is free of such an arch structure, the band is merely fed to the table A2 and put in a ring-like manner on the table. Then, the distal end of the band is gripped as described above. Thus, feeding and charging of the band with respect to the arch structure is completed.

Thereafter, the package A15 is put on the table A2 (FIG. 2) and then a start switch (not shown) is turned on. This causes the cam shaft electromagnetic clutch mounted on the input shaft of the cam shaft reducer 44 to be actuated to rotate the cam shaft 4, so that the distal end of the band is gripped by the band gripping and bonding unit A12. Subsequently, the solenoid 87 is excited, so that the rod 88 may cause the arm rod 98 to be pivotally moved against the spring 94. Such pivotal movement of the arm rod 98 causes the return touch roller 13 to be pressedly contacted with the return roller 10 through the band B, so that the return roller 10 being rotated at a high speed may draw back the band B.

Figure 8:
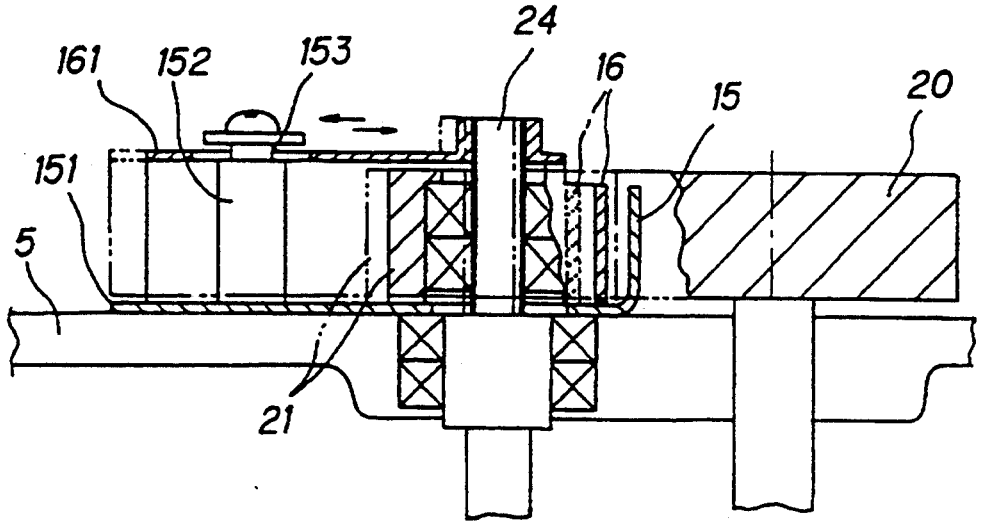
FIG. 8 is a sectional view taken along line VIII—VIII of FIG. 7.

At this time, tile solenoid 27 is kept excited, therefore, the eccentric shaft 24 is pivotally moved, resulting in the feed touch roller 21 being separated from the feed roller 20 and the movable guide plate 16 being moved to a position separated from the stationary guide plate 15, as indicated at two-dot chain lines in FIG. 8. This causes the gap of the band passage 41c of the feed chute 30 to be enlarged. Therefore, the band B being drawn back is passed through the band passage 41b of the tension chute 59 and fed to the band passage 41c of which the gap is widened, so that jamming of the band at the boundary area between the band passages 41b and 41c may be substantially prevented. Also, the feed touch roller 21 is moved substantially simultaneous or together with the feed chute 30, to thereby prevent formation of a gap between the feed touch roller 21 and the feed chute 30, resulting in jamming of the band in such a gap being prevented.

The band is thus drawn back, to thereby rush cut of the arch structure A3, resulting in being wound around the package A15. This causes a rotational speed of, for example, the return touch roller 13 to be reduced. Such reduction of the rotational speed is detected through a suitable detection means (not shown), resulting in a detection signal being generated from the detection means. The solenoid 55 is excited by the detection signal, so that the arm rod 57 is upwardly pivotally moved in FIG. 4 to cause the tension touch roller 54 to be pressedly contacted with the tension roller 51.

Also, the detection signal generated from the detection means causes the electromagnetic clutch (not shown) for the tension roller 51 to be actuated, so that the tension roller 51 may be rotated at a low speed and a high torque through the tension roller reducer 52. More particularly, driving force of a motor is transmitted through the belt 43 to the pulley 12b mounted on the input shaft of the can shaft reducer 44 to constantly rotate the pulley 12b. The pulley 12b is operatively connected through the flat belt 14 to the pulleys 12a and 12c, so that the pulleys 12a and 12c may be likewise rotated. Concurrently, rotation of the pulley 12b causes the pulley 67b to be rotated through the electromagnetic clutch for the tension roller and then the tension roller 51 to be rotated through the V belt 68 and tension roller reducer 52. When the above-described detection signal is not generated, the electromagnetic clutch for the tension roller is not actuated, so that tension roller reducer 52 is not actuated, to thereby fail in rotation of the tension roller 51. Nevertheless, the return roller 10 and feed roller 20 are constantly rotated by the pulleys 12a and 12c, respectively.

Thus, in the illustrated embodiment, the return roller 10 for drawing back the band and the tension roller 51 for tightening the band are provided separate from each other. Such construction of the illustrated embodiment eliminates a necessity of passing the band through an outer periphery of a roller reversely rotated at a high speed. More particularly, the tension roller 51 of which an outer periphery is passed by the band is not rotated during feeding of the belt. Therefore, even when the band is contacted with the tension roller 51 during feeding of the band, there is substantially decreased a possibility that jamming of the band occurs because the tension roller 51 is stopped. Also, the band is passed through the band passage 41a in which the return roller 10 reversely rotated at a high speed is arranged; however, the illustrated embodiment eliminates a necessity of passing the band through the outer periphery of the return roller 10 by an increased distance, to thereby significantly reduce a possibility of band jamming as compared with the prior art.

Further, in the illustrated embodiment, the solenoid 87 is released from excitation immediately after the tension touch roller 54 is pressedly contacted with the tension roller 51 due to excitation of the solenoid 55, so that the return touch roller 13 may be separated from the return roller 10. Thus, the band is immediately changed from the drawn-back state to the tightened state without being loosened.

As described above, the tension touch roller 54 is pressedly contacted with the tension roller 51 and concurrently the arm rod 57 causes the tension chute 59 to be upwardly moved along the elongated hole 61 as shown in FIG. 4, resulting in the tension chute 59 reaching the position indicated at two-dash chain lines in FIG. 4. This causes the gap of the lower end of the band passage **41*b* to be narrowed and kept narrowed during tightening of the band. The band is moved from the narrowed lower end of the band passage 41*b* to the band passage 41*c* of which the gap is kept enlarged. Thus, the illustrated embodiment effectively prevents jamming of the band at the boundary area between the band passage 41*b* and the band passage 41*a*** during tightening of the band.

The above-described tightening of the band by the tension roller 51 is carried out for a predetermined length of time. More particularly, the detection signal generated due to detection of a decrease in the number of rotations of the return touch roller 13 as described above is input to a timer (not shown) to cause the timer to start counting, so that the tightening is carried out until a predetermined length of time set by the timer elapses. This causes the band to be tightly wound around the package A15 (FIG. 2). The predetermined length of time expires, the electromagnetic clutch for the tension roller which rotates the pulley **67*b* is turned off to complete tightening of the band. The band is kept tightened by the band gripping and bonding unit A12** and an overlapped portion of the band is bonded by welding. Then, a portion of the band wound on the package is cut from the remaining portion of the band.

While a preferred embodiment of the invention has been described with a certain degree of particularity with reference to the drawing, obvious modifications and variations are possible in light of the above teachings. It is therefore to be understood that within the scope of the appended claims, the invention may be practiced otherwise than as specifically described.

What is claimed is:

1. A band feeding and tightening apparatus for a packing machine which is adapted to feed a band to a package to surround it with the band, grip a distal end of the band, draw back the band to tighten it, bond an overlapped portion of the band and cut a portion of the band wound around the package from the remaining portion of the band, comprising:

a feed roller rotatable at a high speed to feed the band;

a movable feed touch roller arranged to access to said feed roller through the band;

a return roller rotatable at a high speed to draw back the band;

a return touch roller arranged to access to said return roller through the band;

a tension roller rotatable at a low speed and a high torque to tighten the band;

a tension touch roller arranged to access to said tension roller through the band;

feed chute means for providing a band passage between said feed roller and said tension roller through which the band is passed in a direction of movement, said band passage of said feed chute constituting an elongated gap having a dimension transverse to said direction of band movement;

a tension chute communicating with said feed chute means, said tension chute having an arc-like shape providing a band passage around said tension roller;

a return chute communicating with said tension chute and providing a band passage between said tension roller and said return roller; and a dimension varying mechanism for varying said transverse dimension of said gap of said feed chute means, said dimension varying mechanism reducing said transverse dimension of said gap to a dimension approaching a lower limit which permits passing of the band when the band is fed and enlarging the transverse dimension of said gap when the band is drawn back or tightened.

2. A band feeding and tightening apparatus as defined in claim 1, wherein said feed chute means comprises a stationary guide plate and a movable guide plate spaced from said stationary guide plate to define the gap; and said dimension varying mechanism comprises an association mechanism for moving said movable guide plate in association with movement of said feed touch roller.

3. A band feeding and tightening apparatus for a packing machine which is adapted to feed a band to a package to surround it with the band, grip a distal end of the band, draw back the band to tighten it, bond an overlapped portion of the band and cut a portion of the band wound around the package from the remaining portion of the band, comprising:

a feed roller rotatable at a high speed to feed the band;

a feed touch roller arranged to access to said feed roller through the band;

a return roller rotatable at a high speed to draw back the band;

a return touch roller arranged to access to said return roller through the band;

a tension roller rotatable at a low speed and a high torque to tighten the band;

a movable tension touch roller arranged to access to said tension roller through the band;

a feed chute for providing a band passage between said feed roller and said tension roller;

tension chute means communicating with said feed chute, said tension chute means having an arc-like shape providing a band passage around said tension roller through which the band is passed in a direction of movement, said band passage of said tension chute means constituting an arc-shaped gap having a dimension transverse to said direction of band movement;

a return chute communicating with said tension chute means and providing a band passage between said tension roller and said return roller;

said gap of said arc-like tension chute means having a first end portion communicating with said return chute and a second end portion communicating with said feed chute, and a dimension varying mechanism comprising means for varying the transverse dimension of said gap of said arc-like tension chute means;

said dimension varying mechanism varying the transverse dimension of said gap of said arc-like tension chute means such that when the band is fed, the transverse dimension of said first portion of said gap of said arc-like tension chute means is reduced to a dimension approaching a lower limit which permits passing of the band and the transverse dimension of said second portion of said gap of said arc-like tension chute means is enlarged and such that when the band is tightened, the transverse dimension of said first portion of said gap of said arc-like tension chute means is enlarged and the transverse dimension of said second portion of said gap of said arc-like tension chute means is reduced to a dimension approaching a lower limit which permits passing of the band.

4. A band feeding and tightening apparatus as defined in claim 3, wherein tension chute means comprises a member arranged around said tension roller and having an arc-shaped recess which is concentric with said tension roller; and said dimension varying mechanism comprises an association mechanism for moving said tension chute means in a chord direction of said arc in association with movement of said tension touch roller.

5. A band feeding and tightening apparatus as defined in claim 2, wherein said movable guide plate comprises an insertion hole and an elongated hole, said feed touch roller rotating about a shaft, inserted into said insertion hole, said stationary guide plate comprising a guide pin mounted thereon and projecting therefrom, said guide pin being inserted into said elongated hole formed through said movable guide plate, such that the direction of movement of said movable guide plate is regulatable by said elongated hole.

6. A band feeding and tightening apparatus as defined in claim 4, wherein said association mechanism comprises an arm rod for enabling movement of said tension touch roller, said arm rod being engaged with said tension chute means, and a guide pin mounted on a base of said apparatus and projecting therefrom, said guide pin being inserted into an elongated hole formed through said tension chute means such that the direction of movement of said tension chute means is regulatable by said elongated hole.

7. A band feeding and tightening apparatus for a packing machine which is adapted to feed a band to a package to surround it with the band, grip a distal end of the band, draw back the band to tighten it, bond an overlapped portion of the band and cut a portion of the band wound around the package from the remaining portion of the band, comprising:

a feed roller rotatable at a high speed to feed the band;

a feed touch roller arranged to access to said feed roller through the band;

a return roller rotatable at a high speed to draw back the band, said return roller being arranged after said feed roller in the direction of feed of the band;

a return touch roller arranged to access to said return roller through the band;

a tension roller rotatable at a low speed and a high torque to tighten the band, said tension roller being between said feed roller and said return roller;

a tension touch roller arranged to access to said tension roller through the band;

feed chute means for providing a band passage between said feed roller and said tension roller through which the band is passed in a direction of movement, said band passage of said feed chute means constituting an elongated gap having a dimension transverse to said direction of band movement;

a tension chute communicating with said feed chute means, said tension chute having an arc-like shape providing a band passage around said tension roller;

a return chute communicating with said tension chute and providing a band passage between said tension roller and said return roller; and dimension varying means for regulating the transverse dimension of said gap of said feed chute means in a direction of thickness of the band, said dimension varying means reducing the transverse dimension of said gap to a dimension approaching a lower limit which permits passing of the band when the band is fed and enlarging the transverse dimension of said gap when the band is drawn back or tightened.

8. The band feeding and tightening apparatus as defined in claim 1, wherein said feed chute means comprises a stationary guide plate and a movable guide plate spaced from said stationary guide plate to define said gap; and said dimension varying means comprising means for moving said movable guide plate in relation to movement of said feed touch roller.

* * * * *